US007615918B2

(12) United States Patent
Lee et al.

(10) Patent No.: US 7,615,918 B2
(45) Date of Patent: Nov. 10, 2009

(54) LIGHT EMISSION DEVICE WITH HEAT GENERATING MEMBER

(75) Inventors: Sang-Jo Lee, Yongin-si (KR); Chun-Gyoo Lee, Yongin-si (KR); Sang-Ho Jeon, Yongin-si (KR); Jin-Hui Cho, Yongin-si (KR); Sang-Hyuck Ahn, Yongin-si (KR); Su-Bong Hong, Yongin-si (KR); Byung-Gil Jea, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 399 days.

(21) Appl. No.: 11/690,059

(22) Filed: Mar. 22, 2007

(65) Prior Publication Data

US 2007/0267638 A1 Nov. 22, 2007

(30) Foreign Application Priority Data

May 18, 2006 (KR) ..... 10-2006-0044632

(51) Int. Cl.
*H01J 1/62* (2006.01)

(52) U.S. Cl. ..... 313/495; 313/496

(58) Field of Classification Search ..... 313/495, 313/496, 44, 309
See application file for complete search history.

(56) References Cited

U.S. PATENT DOCUMENTS 6,441,548 B1 * 8/2002 Arimoto ..... 313/491

* cited by examiner

*Primary Examiner*—Vip Patel
(74) *Attorney, Agent, or Firm*—Christie, Parker & Hale, LLP

(57) ABSTRACT

A light emission device includes: first and second substrates facing each other and spaced apart from each other; an electron emission region on an inner surface of the first substrate; a driving electrode on the inner surface of the first substrate to control an electron emission of the electron emission region; a phosphor layer on an inner surface of the second substrate; and a heat generation member on the inner surface of the second substrate or an outer surface of the second substrate to increase a temperature of the second substrate.

20 Claims, 5 Drawing Sheets

LIGHT EMISSION DEVICE WITH HEAT GENERATING MEMBER

CROSS-REFERENCES TO RELATED APPLICATION

This application claims priority to and the benefit of Korean Patent Application No. 10-2006-0044632, filed on May 18, 2006, in the Korean Intellectual Property Office, the entire content of which is incorporated herein by reference.

BACKGROUND OF THE INVENTION

1. Field of the Invention

The present invention relates to a light emission device and an electron emission display, and more particularly, to a light emission device and an electron emission display, which are capable of reducing a temperature difference between first and second substrates of the electron emission display during an operation thereof.

2. Description of the Related Art

A light emission device can be a device that emits visible light by exciting a phosphor layer using electrons emitted from an electron emission region. The light emission device includes a first substrate having an electron emission region and a driving electrode, and a second substrate having a phosphor layer and an anode electrode.

The light emission device has an internal vacuum space so that the emission and migration of electrons can effectively occur in the internal vacuum space. The first and second substrates are sealed together at their peripheries using a sealing member, and the inner space between the first and second substrates is exhausted to form a vacuum vessel. A high compression force is applied to the vacuum vessel due to a pressure difference between the interior and exterior of the vacuum vessel. Therefore, spacers are installed in the vacuum vessel to withstand the compression force applied to the vacuum vessel.

However, after the light emission device has been operating for a relatively long period of time, the driving electrode arranged on the first substrate may generate heat to cause a temperature difference between the first and second substrates. Therefore, there may be a temperature difference between upper and lower ends of the spacer, which face the second and first substrates, respectively. The temperature difference between the different locations of the spacer causes a resistivity difference between the different locations of the spacer, thereby varying a surface electric potential along a height direction of the spacer.

As a result, the spacer attracts or repels the electrons traveling around thereof, and the electron beam path is distorted. Therefore, the phosphor layer around the spacer may emit either too much or too little light, thereby causing the spacer to be viewable on the light emission surface.

SUMMARY OF THE INVENTION

An aspect of the present invention provides a light emission device and an electron emission display that are capable of suppressing an electron beam distortion around a spacer by reducing or minimizing a temperature difference between first and second substrates during an operation thereof.

In an exemplary embodiment of the present invention, a light emission device includes: first and second substrates facing each other and spaced apart from each other; an electron emission region provided on an inner surface of the first substrate; a driving electrode disposed on the inner surface of the first substrate, and adapted to control an electron emission of the electron emission region; a phosphor layer formed on an inner surface of the second substrate; and a heat generation member on the inner surface of the second substrate or an outer surface of the second substrate, and adapted to increase a temperature of the second substrate.

The heat generation member may include a heat wire extending along at least one direction parallel to the inner and outer surfaces of the second substrate. The heat wire may have a black surface. The light emission device may further include a light absorption layer covering the heat wire, the light absorption layer having a width greater than that of the heat wire.

The phosphor layer may include a plurality of phosphor sections spaced apart from each other. A black layer may be formed between the phosphor sections. In this case, the heat wire may be positioned on the outer surface of the second substrate to correspond to the black layer. In addition, a light absorption layer may be formed on the outer surface of the second substrate while covering the heat wire. In one embodiment, the light absorption layer has a width substantially identical to that of the black layer. Alternatively, the heat wire may be positioned on the inner surface of the second substrate and covered with the black layer.

The heat wire may be positioned to correspond to the black layer and include first heat wires extending along a first direction parallel to the inner and outer surfaces of the second substrate and second heat wires extending along a second direction crossing the first direction.

The driving electrode may include scan electrodes and data electrodes crossing the scan electrodes, the scan electrodes being insulated from the data electrodes by an insulating layer. The electron emission region may be electrically connected to the scan electrodes or the data electrodes. The light emission device may further include a focusing electrode disposed above the driving electrode and insulated from the driving electrode.

In another exemplary embodiment of the present invention, an electron emission display includes: first and second substrates facing each other and spaced apart from each other; an electron emission region provided on an inner surface of the first substrate; a driving electrode disposed on the inner surface of the first substrate, and adapted to control an electron emission of the electron emission region; a plurality of phosphor layers formed on an inner surface of the second substrate and spaced apart from each other; a black layer disposed between the phosphor layers; and a heat generation member provided on the inner surface of the second substrate or an outer surface of the second substrate, and adapted to increase a temperature of the second substrate, the heat generation member being disposed to correspond to the black layer.

The heat generation member may include a heat wire extending along at least one direction parallel to the inner and outer surfaces of the second substrate and provided with a black surface. The heat wire may be positioned on the outer surface of the second substrate and the electron emission display may further include a light absorption layer covering the heat wire. The light absorption layer has a width substantially identical to that of the black layer.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
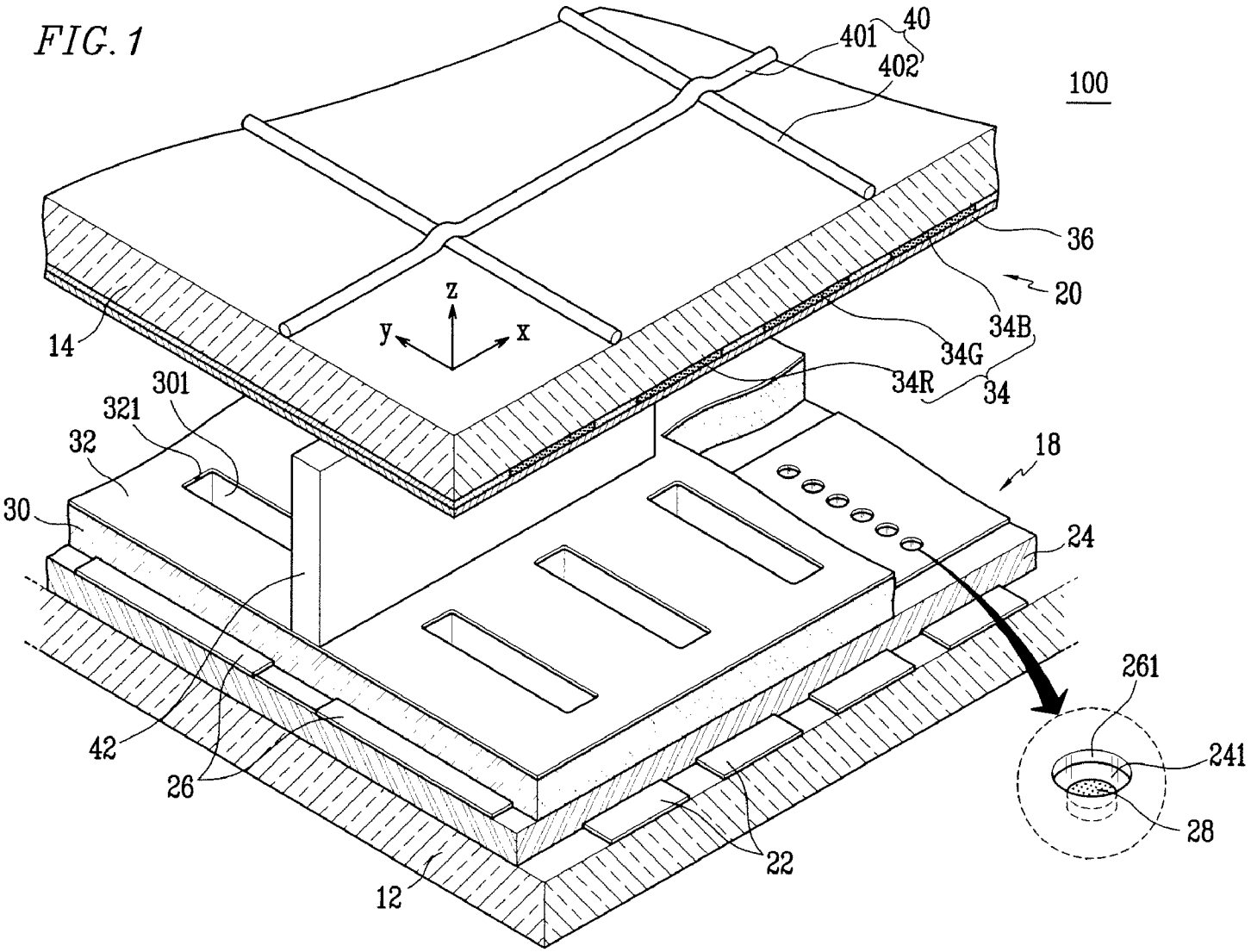
FIG. 1 is a partial exploded perspective view of a light emission device according to a first embodiment of the present invention.

In the following detailed description, only certain exemplary embodiments of the present invention are shown and described, by way of illustration. As those skilled in the art would recognize, the invention may be embodied in many different forms and should not be construed as being limited to the embodiments set forth herein. Also, in the context of the present application, when an element is referred to as being "on" another element, it can be directly on the another element or be indirectly on the another element with one or more intervening elements interposed therebetween. Like reference numerals designate like elements throughout the specification.

In exemplary embodiments of the present invention, a light emission device includes any suitable devices that can emit light externally so that the emitted light can be externally recognized. Therefore, any suitable display devices that can provide information by displaying symbols, characters, numbers, and other images can be a light emission device. In addition, a light emission device can be used as a light source for emitting light to a non-self-emissive display panel.

Figure 2:
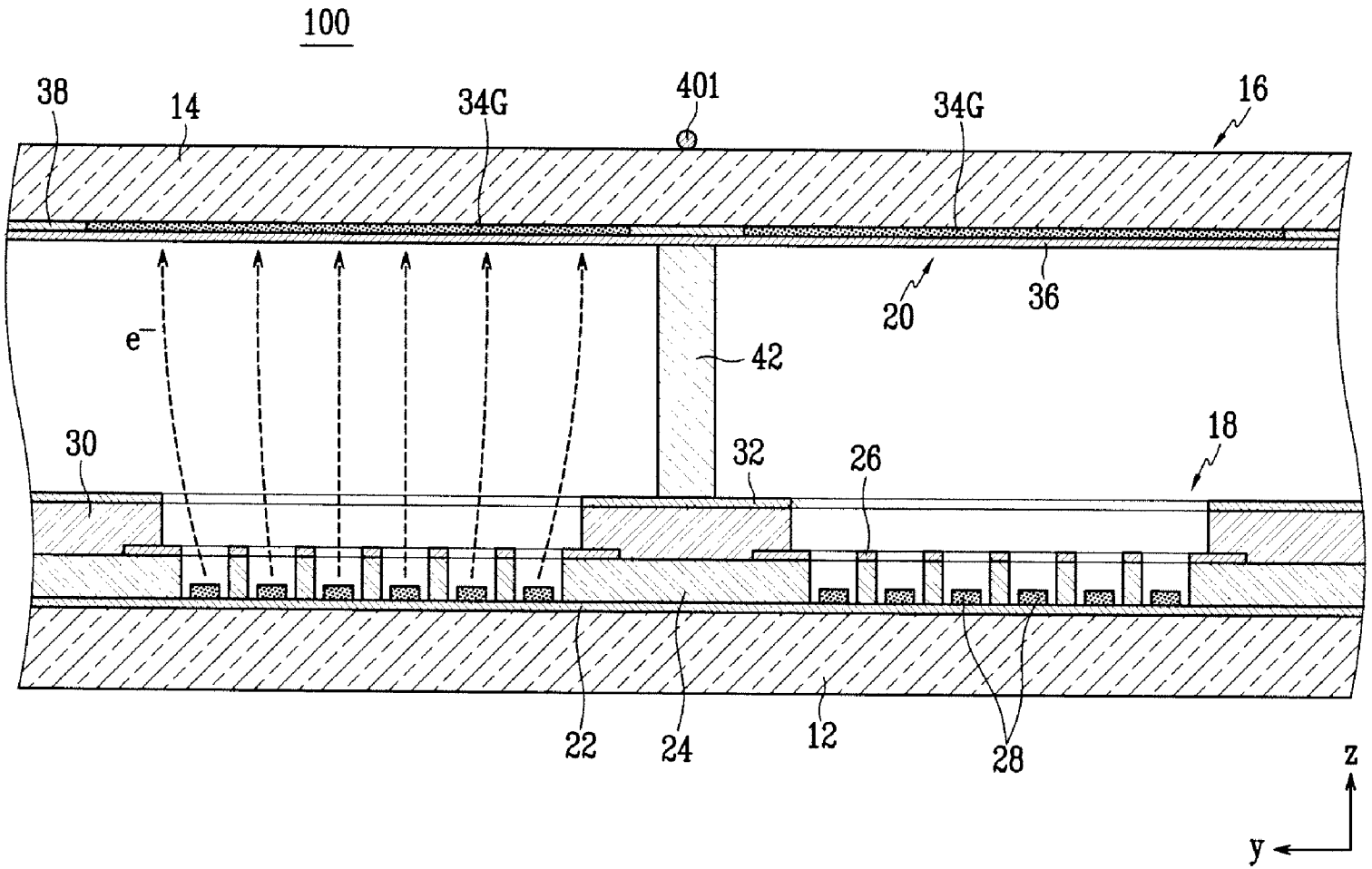
FIG. 2 is a partial sectional view of the light emission device of FIG. 1.

FIGS. 1 and 2 are respectively partial exploded perspective and partial sectional views of a light emission device according to a first embodiment of the present invention.

Referring to FIGS. 1 and 2, a light emission device 100 of the present embodiment includes first and second substrates 12 and 14 facing each other in parallel with a distance therebetween (wherein the distance may be predetermined). A sealing member is provided between the first and second substrates 12 and 14 to seal the first and second substrates 12 and 14 together to thus form a vacuum vessel (or vacuum chamber) 16. The interior of the vacuum vessel 16 is kept to a degree of vacuum of about $10^{-6}$ Torr.

Each of the first and second substrates 12 and 14 is divided into an active area substantially for emitting visible light and an inactive area surrounding the active area. An electron emission unit 18 for emitting electrons is provided on the active area of the first substrate 12 and a light emission unit 20 for emitting the visible light is provided on the active area of the second substrate 14.

The electron emission unit 18 may be a field emission array (FEA) type, a surface-conduction emitter (SCE) type, a metal-insulator-metal (MIM) type, or a metal-insulator-semiconductor (MIS) type. Regardless of the type, the electron emission unit 18 includes electron emission regions and driving electrodes.

FIGS. 1 and 2 illustrate a case where the electron emission unit 18 is the FEA type. However, the present invention is not limited to this case.

The electron emission unit 18 includes cathode electrodes 22, gate electrodes 26 formed above the cathode electrodes 22 and extending along a direction crossing the cathode electrodes 22 with a first insulating layer 24 interposed between the cathode electrodes 22 and the gate electrodes 26, and electron emission regions 28 formed on the cathode electrodes 22. Openings 241 and openings 261, which correspond to the respective electron emission regions 28, are respectively formed in the first insulating layer 24 and the gate electrodes 26.

In one embodiment, one of the gate electrodes 26 extending along a row direction of the light emission device 100 functions as a scan electrode by receiving a scan driving voltage, and one of the cathode electrodes 22 extending along a column direction of the light emission device 100 functions as a data electrode by receiving a data driving voltage (or vice versa).

The electron emission regions 28 are formed of a material for emitting electrons when an electric field is applied thereto under a vacuum atmosphere, such as a carbon-based material or a nanometer-sized material. For example, the electron emission regions 28 may include a material selected from the group consisting of carbon nanotubes, graphite, graphite nanofibers, diamonds, diamond-like carbon, fullerene ($C_{60}$), silicon nanowires, and combinations thereof.

The electron emission unit 18 may further include a second insulating layer 30 formed on the first insulating layer 24 while covering the gate electrodes 26 and a focusing electrode 32 formed on the second insulating layer 30. Openings 321 and openings 301 are respectively formed in the focusing electrode 32 and the second insulating layer 30. The openings 321 and 301 may be formed to correspond to the respective electron emission regions 28 or to respective crossed regions of the cathode and gate electrodes 22 and 26. In FIGS. 1 and 2, the latter case is illustrated.

The light emission unit 20 includes a phosphor layer 34 and an anode electrode 36 formed on a surface of the phosphor layer 34. The phosphor layer 34 may be formed on the entire active region of the second substrate 14. Alternatively, the phosphor layer 34 may be patterned to have a plurality of sections spaced part from each other. In this case, a black layer 38 may be formed between the sections of the phosphor layers 34.

Particularly, the sections of the phosphor layers 34 may be red, green, and blue phosphor layers 34R, 34G, and 34B. The black layer 38 may be disposed in a matrix pattern between the red, green and blue phosphor layers 34R, 34G, and 34B. The light emission device having the above-described light emission unit 20 can display a full-color image. In the context of the present application, the light emission device can be referred to as an electron emission display. In FIGS. 1 and 2, an example where the phosphor layer 34 is formed with the red, green and blue phosphor layers 34R, 34G, and 34B is illustrated.

The anode electrode 36 may be formed of a metal layer such as an aluminum (Al) layer covering the phosphor layer 34. The anode electrode 36 is an acceleration electrode that receives a high voltage to maintain the phosphor layer 34 at a high electric potential state. In one embodiment, the anode electrode 36 also functions to enhance the luminance by reflecting the visible light, which is emitted from the phosphor layer 34 to the first substrate 12 back toward the second substrate 14.

Alternatively, the anode electrode may be a transparent conductive layer formed of, for example, indium tin oxide (ITO). In this case, the anode electrode is formed on a surface of the phosphor layer 34 facing the second substrate 14. Alternatively, the anode electrode may include both of a transparent conductive layer and a metal layer.

Figure 3:
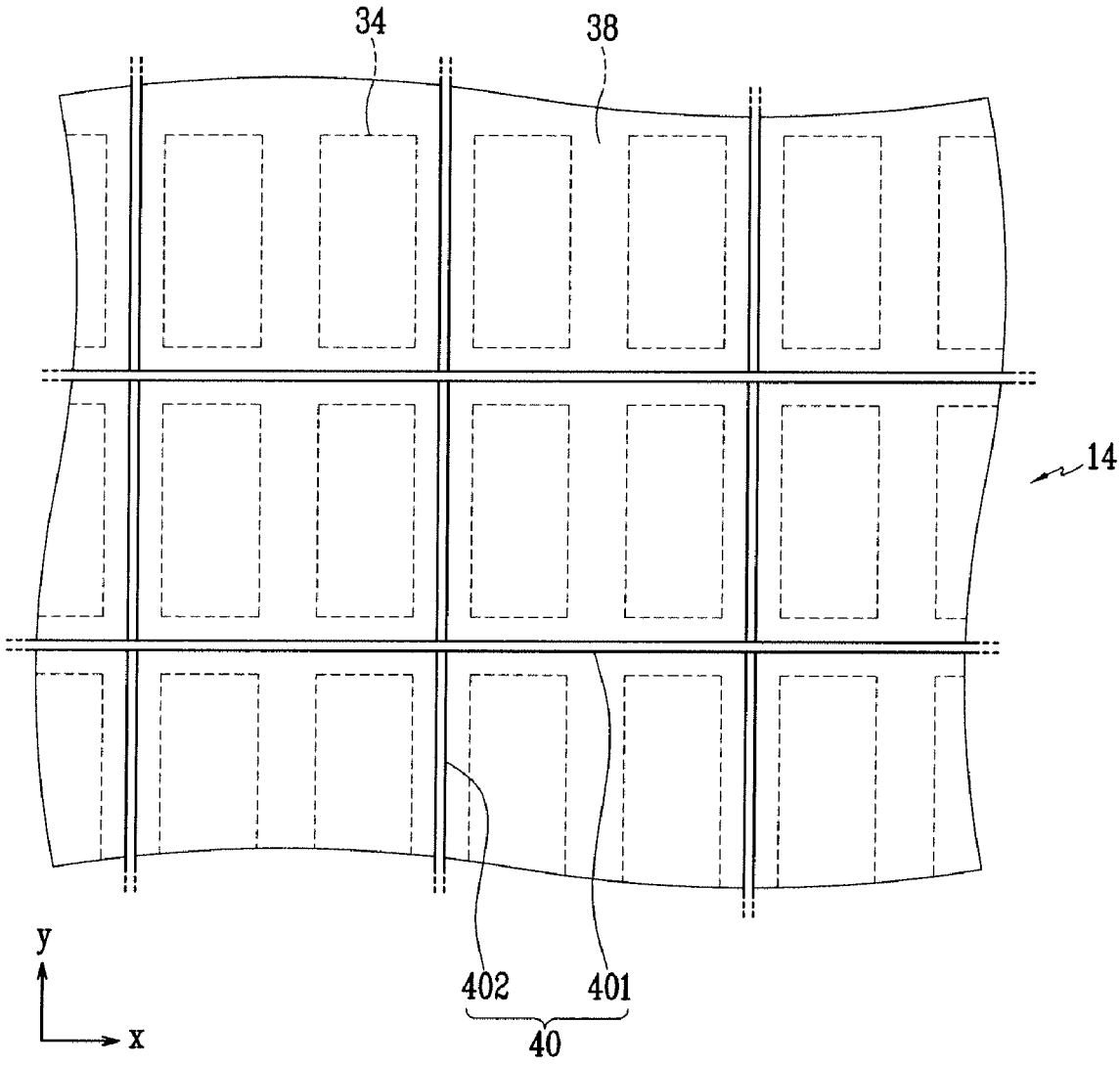
FIG. 3 is a partial top view of a second substrate of FIG. 1.

FIG. 3 is a partial top view of the second substrate 14.

Referring to FIGS. 1 through 3, a heat generation member for heating the second substrate 14 is disposed on an outer surface of the second substrate 14. The heat generation member may be formed of a heat wire 40 having a relatively small diameter. In this case, even when the heat wire 40 is disposed above the phosphor layer 34, the obstruction of the visible light by the heat wire 40 can be minimized.

When the light emission unit 20 includes the black layer 38, the heat wires 40 may be disposed above the black layer 38. In addition, the heat wires 40 may be arranged above the black layer 38 in a line pattern extending along a direction of the second substrate 14. Alternatively, the heat wires 40 may be arranged in a matrix pattern extending along both a first direction and a second direction to cross each other.

For example, the heat wires 40 include first heat wires 401 extending along a first direction (the x-axis of FIG. 3) parallel to the inner and outer surfaces of the second substrate 14 and second heat wires 402 extending along a second direction (the y-axis of FIG. 3) crossing the first direction. The first heat wires 401 may be arranged with one or more phosphor layers 34 interposed therebetween. The second heat wires 402 also may be arranged with one or more phosphor layers 34 interposed therebetween. However, the arrangement of the heat wires 40 is not limited to this embodiment.

In FIG. 3, an example where the first heat wires 401 are arranged with one phosphor layer 34 interposed therebetween and the second heat wires 402 are arranged with two phosphor layers 34 interposed therebetween is illustrated. However, the arrangement of the heat wires 40 is not limited to this example. That is, the heat wires 40 may be arranged in a variety of suitable patterns.

Each heat wire 40 may have a black surface. In this case, since the heat wires 40 absorb external light incident onto the second substrate 14, the external light reflection can be reduced.

Disposed between the first and second substrates 12 and 14 are spacers 42 adapted to withstand a compression force applied to the vacuum vessel 16 and to uniformly maintain a gap between the first and second substrates 12 and 14. The spacers 42 are disposed to correspond to the black layer 38 so as not to interfere with the light emission of the phosphor layer 34. In FIG. 1, short bar type spacers are exemplarily illustrated.

The above-described light emission device 100 is driven by applying driving voltages to the cathode electrodes 22, gate electrodes 26, focusing electrode 32, and anode electrode 36.

For example, one of the cathode electrodes 22 is applied with a scan driving voltage, and one of the gate electrodes 26 is applied with a data driving voltage (or vice versa). The focusing electrode 32 is applied with a voltage, e.g., 0V or several through tens volts of a negative direct current (DC) voltage, to focus (or converge) the electron beams. The anode electrode 36 is applied with a voltage, e.g., several hundreds through thousands volts of a positive direct current (DC) voltage, to accelerate the electron beams.

Then, electric fields are formed around the electron emission regions 28 at the pixels (that may be defined at crossed regions of the cathode and gate electrodes 22 and 26) where the voltage difference between the cathode and gate electrodes 22 and 26 is equal to or greater than the threshold value, and thus electrons are emitted from the electron emission regions 28. The emitted electrons pass through the opening 321 of the focusing electrode 32, and are centrally focused (or converged) into a bundle of electron beams. The bundle of electron beams are attracted by the high voltage applied to the anode electrode 36, and collide with the phosphor layer 34 of the relevant pixels, thereby exciting the phosphor layer 34 to emit light.

When the above-described driving process is being operated for a relatively long period of time, the driving electrodes, i.e., the cathode and gate electrodes 22 and 26, generates heat. Due to this heat, there may be a temperature difference between the first and second substrates 12 and 14. Here, the heat wires 40 connected to an external power source generate heat to increase the temperature of the second substrate 14, thereby reducing (or minimizing) the temperature difference between the first and second substrates 12 and 14.

As a result, the temperature difference does not occur or is reduced (or minimized) in each of the spacers 42 along a height direction (the z-axis of FIG. 1) of the spacer 42. Therefore, the surface electric potential can be uniformly maintained at any location for each spacer 42 along the height direction. Therefore, the electron beams are not distorted around the spacers 42, thereby reducing (or minimizing) the phosphor layers 34 around the spacers 42 from emitting too much or too little light.

According to the above-described light emission device 100 of the present embodiment, the light emission uniformity can be improved and a problem where the spacers 42 can be viewed on the light emission surface can be reduced or eliminated. In addition, when the light emission device 100 is an electron emission display, the external light reflection is reduced as the heat wires 40 having the black surface absorb the external light, thereby enhancing the contrast of a screen of the electron emission display.

Figure 4:
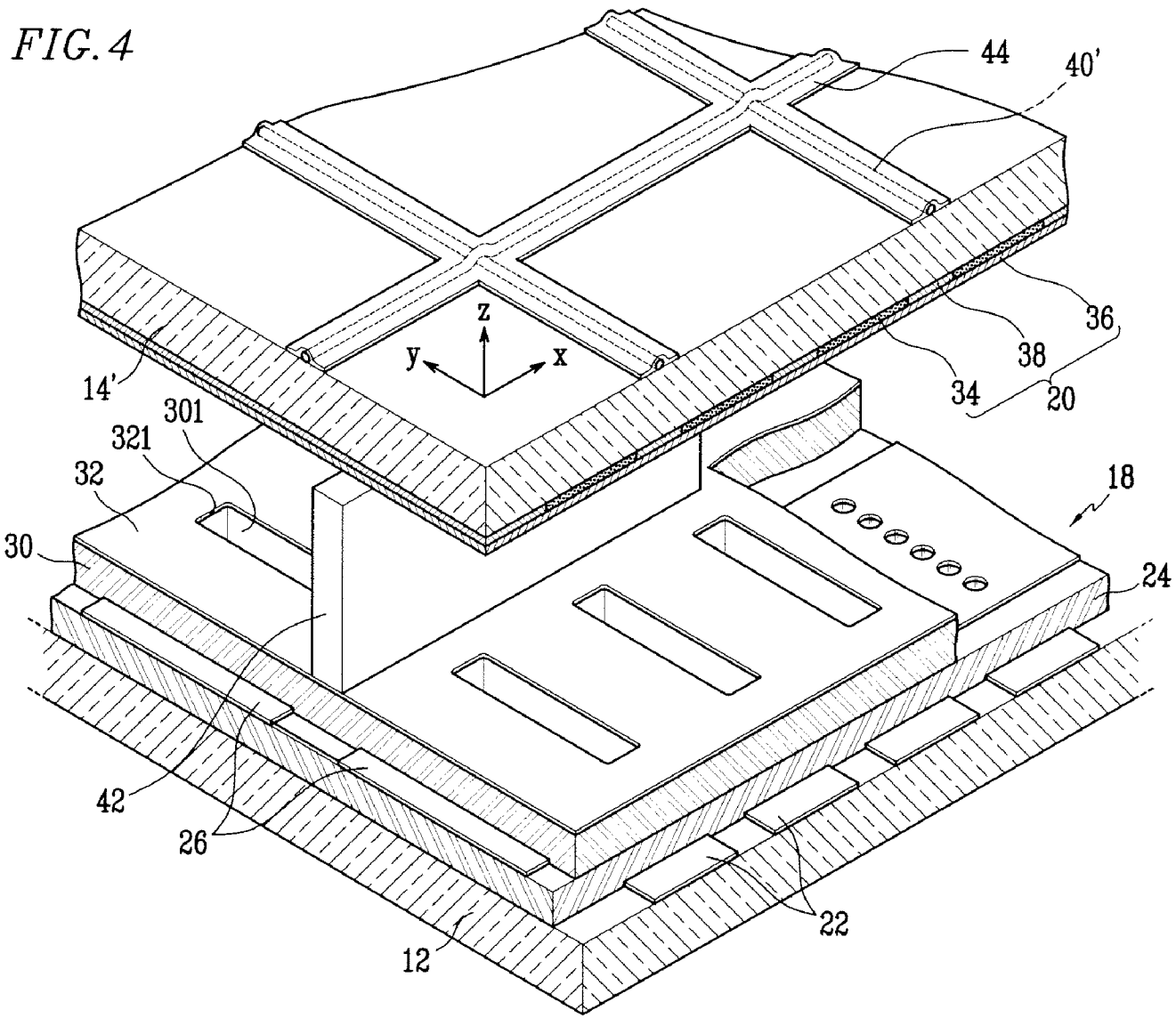
FIG. 4 is a partial exploded perspective view of a light emission device according to a second embodiment of the present invention.

FIG. 4 is a partial exploded perspective view of a light emission device according to a second embodiment of the present invention. The light emission device of FIG. 4 has a structure that is substantially the same as the embodiment of FIGS. 1, 2, and 3. Therefore, only parts that are different will be described in more detail below.

Referring to FIG. 4, heat wires 40' are arranged on an outer surface of a second substrate 14' and light absorption layers 44, each having a width greater than that of the heat wire 40' are arranged to cover the heat wires 40'. The light absorption layers 44 may be formed to correspond to the black layer 38, having a width identical to that of the black layer 38. The light absorption layers 44 reduce the external light reflection of the second substrate 14', thereby more effectively enhancing the contrast of the screen.

Figure 5:
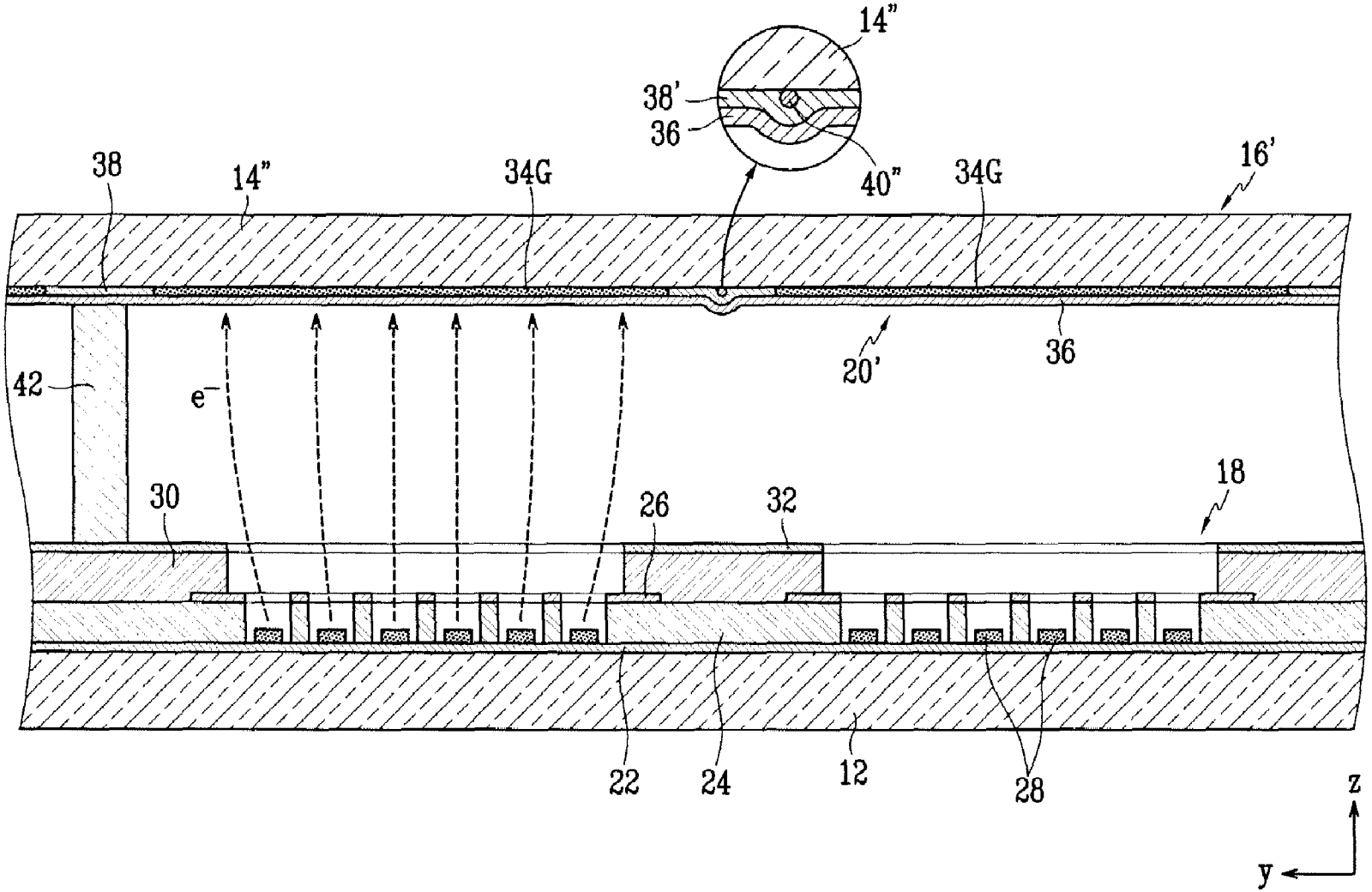
FIG. 5 is a partial sectional view of a light emission device according to a third embodiment of the present invention.

FIG. 5 is a partial sectional view of a light emission device according to a third embodiment of the present invention. The light emission device of FIG. 5 has a structure that is substantially the same as the embodiment of FIGS. 1, 2, and 3. Therefore, only parts that are different will be described in more detail below.

Referring to FIG. 5, heat wires 40" are arranged on an inner surface of a second substrate 14" (or an inner surface of a vacuum vessel 16'). Particularly, when a light emission unit 20' includes a black layer 38', the heat wires 40" are first disposed on a portion where the black layer 38' will be positioned. Then, the black layer 38' is formed on the inner surface of the second substrate 14" while covering the heat wires 40". End portions of the heat wires 40" extend out of the vacuum vessel 16' through a sealing member and are connected to an external power source.

While the invention has been described in connection with certain exemplary embodiments, it will be appreciated by those skilled in the art that the invention is not limited to the disclosed embodiments, but, on the contrary, is intended to cover various modifications included within the principles and spirit of the invention, the scope of which is defined in the claims and their equivalents.

What is claimed is:

1. A light emission device comprising:

first and second substrates facing each other and spaced apart from each other;

an electron emission region disposed on an inner surface of the first substrate;

a driving electrode disposed on the inner surface of the first substrate, and adapted to control an electron emission of the electron emission region;

a phosphor layer disposed on an inner surface of the second substrate; and a heat generation member disposed on the inner surface of the second substrate or an outer surface of the second substrate, and adapted to increase a temperature of the second substrate.

2. The light emission device of claim 1, wherein the heat generation member includes a heat wire extending along at least one direction parallel to the inner and outer surfaces of the second substrate.

3. The light emission device of claim 2, wherein the heat wire has a black surface.

4. The light emission device of claim 2, further comprising a light absorption layer covering the heat wire, the light absorption layer having a width greater than that of the heat wire.

5. The light emission device of claim 2, wherein the phosphor layer includes a plurality of phosphor sections spaced apart from each other and the light emission device further comprises a black layer formed between the phosphor sections.

6. The light emission device of claim 5, wherein the heat wire is positioned on the outer surface of the second substrate to correspond to the black layer.

7. The light emission device of claim 6, further comprising a light absorption layer disposed on the outer surface of the second substrate to cover the heat wire, the light absorption layer having a width substantially identical to that of the black layer.

8. The light emission device of claim 5, wherein the heat wire is positioned on the inner surface of the second substrate and covered with the black layer.

9. The light emission device of claim 5, wherein the heat wire is positioned to correspond to the black layer and comprises first heat wires extending along a first direction parallel to the inner and outer surfaces of the second substrate and second wires extending along a second direction crossing the first direction.

10. The light emission device of claim 1, wherein the driving electrode includes scan electrodes and data electrodes crossing the scan electrodes, the scan electrodes being insulated from the data electrodes by an insulating layer; and the electron emission region is electrically connected to the scan electrodes or the data electrodes.

11. The light emission device of claim 10, further comprising a focusing electrode disposed above the driving electrode and insulated from the driving electrode.

12. An electron emission display comprising:

first and second substrates facing each other and spaced apart from each other;

an electron emission region disposed on an inner surface of the first substrate;

a driving electrode disposed on the inner surface of the first substrate, and adapted to control an electron emission of the electron emission region;

a plurality of phosphor layers disposed on an inner surface of the second substrate and spaced apart from each other;

a black layer disposed between the phosphor layers; and a heat generation member on the inner surface of the second substrate or an outer surface of the second substrate, and adapted to increase a temperature of the second substrate, the heat generation member being disposed to correspond to the black layer.

13. The electron emission display of claim 12, wherein the heat generation member includes a heat wire extending along at least one direction parallel to the inner and outer surfaces of the second substrate and is provided with a black surface.

14. The electron emission display of claim 13, wherein the heat wire is positioned to correspond to the black layer and comprises first heat wires extending along a first direction parallel to the inner and outer surfaces of the second substrate and second wires extending along a second direction crossing the first direction.

15. The electron emission display of claim 12, wherein the heat wire is positioned on the outer surface of the second substrate and the electron emission display further comprises a light absorption layer covering the heat wire, the light absorption layer having a width substantially identical to that of the black layer.

16. The electron emission display of claim 12, wherein the heat wire is positioned on the inner surface of the second substrate and covered with the black layer.

17. The electron emission display of claim 12, wherein the driving electrode includes scan electrodes and data electrodes crossing the scan electrodes, the scan electrodes being insulated from the data electrodes by an insulating layer; and the electron emission region is electrically connected to the scan electrodes or the data electrodes.

18. The electron emission display of claim 17, further comprising a focusing electrode disposed on the driving electrode and insulated from the driving electrode.

19. The electron emission display of claim 12, further comprising a spacer between the first and second substrates, wherein the heat generation member is adapted to maintain a substantially uniform surface electric potential along a direction of the spacer between the first and second substrates.

20. The electron emission display of claim 12, wherein the heat generation member is adapted to reduce a temperature difference between the first and second substrates.

* * * * *